US005830035A

United States Patent [19]

Budreck

[11] Patent Number: 5,830,035

[45] Date of Patent: Nov. 3, 1998

[54] TOE PUPPET

[76] Inventor: David J. Budreck, 109 E. Woodruff St., Port Washington, Wis. 53074

[21] Appl. No.: 794,294

[22] Filed: Feb. 3, 1997

Related U.S. Application Data

[63] Continuation of Ser. No. 553,885, Nov. 6, 1995, abandoned.

[51] Int. Cl.[6] ..... A63H 03/14

[52] U.S. Cl. ..... 446/366; 446/26; 446/327

[58] Field of Search ..... 446/26, 327, 328, 446/329, 486, 359, 365, 366, 367

[56] References Cited

U.S. PATENT DOCUMENTS

| | | | |
|---|---|---|---|
| D. 292,811 | 11/1987 | Fogarty et al. | D21/153 |
| D. 304,052 | 10/1989 | Dickens | D21/153 |
| 752,607 | 2/1904 | Thowless . | |
| 1,008,619 | 11/1911 | Spear | 446/99 |
| 1,269,056 | 6/1918 | Criest | 446/366 |
| 1,545,120 | 7/1925 | Boggio | 446/366 |
| 2,155,665 | 4/1939 | Leeper . | |
| 2,187,407 | 1/1940 | Stone . | |
| 2,621,440 | 12/1952 | Stone . | |
| 2,624,155 | 1/1953 | Boyce | 446/367 |
| 3,226,849 | 1/1966 | Rosen | 446/329 |
| 3,442,267 | 5/1969 | Krygier | 446/26 |
| 3,501,144 | 3/1970 | Schmidt . | |
| 3,611,628 | 10/1971 | Noble et al. . | |
| 3,911,618 | 10/1975 | Gerst . | |
| 3,918,180 | 11/1975 | Chamberlin | 446/327 |
| 4,148,151 | 4/1979 | Ulrich | 446/367 |
| 4,173,842 | 11/1979 | Bahner . | |
| 4,518,366 | 5/1985 | Fultz et al. | 446/366 |
| 4,992,070 | 2/1991 | Mullen et al. | 446/327 |
| 5,299,967 | 4/1994 | Gilbert | 446/366 |

FOREIGN PATENT DOCUMENTS

| | | | |
|---|---|---|---|
| 7644 | 5/1922 | Germany | 446/366 |
| 1301966 | 8/1969 | Germany | 446/366 |
| 21268 | of 1900 | United Kingdom | 446/367 |

OTHER PUBLICATIONS

"Finger Fun", Washington Post, Mar. 22, 1959, p. c8.

*Primary Examiner*—Robert A. Hafer
*Assistant Examiner*—Jeffrey D. Carlson
*Attorney, Agent, or Firm*—Andrus, Sceales, Starke & Sawall

[57] ABSTRACT

A puppet is adapted to be mounted on a single human digit for providing animated motion of a figurine responsive to movement of the single human digit. The puppet comprises a hollow, elastic cap having an interior wall defining a cavity into which the single human digit is snugly received. The cap includes a resilient neck portion for supporting the figurine at a distance spaced from the single human digit such that movement of the single human digit causes the neck portion and the figurine to oscillate to and fro under the influence of the weight of the figurine.

11 Claims, 1 Drawing Sheet

TOE PUPPET

CROSS REFERENCE TO RELATED APPLICATION

This application is a continuation of application Ser. No. 08/553,885, filed Nov. 6, 1995 now abandoned.

FIELD OF THE INVENTION

This invention relates broadly to puppets, and more particularly, pertains to a puppet adapted to be mounted on a single digit of a human appendage, such as a toe on one's foot, for providing animated motion of a figurine responsive to flexure or similar movement of the single digit.

BACKGROUND OF THE INVENTION

Although the prior art is replete with puppets providing animated movement through the use of two or more digits or fingers, there has been limited development in creating single digit-mounted puppets which provide a three dimensional, amusing effect. One example of a finger puppet worn on a single digit is disclosed in U.S. Pat. No. 3,911,618 issued Oct. 14, 1975 to Gerst. In this patent, correspondingly different facial expressions can be generated by differential movement of the finger joint. That is, when digit flexure occurs at one or more joints, animated movement of a nose, nostrils, and upper lip movement in combination with jaw movement produces a comic facial animation.

It remains desirable to provide a simplified, single digit-mounted puppet in which a minimal amount of flexure will produce a fully animated motion such that a character or figurine moves in a predominantly backward and forward path. It is also desirable to provide a single digit-mounted puppet which may be snugly worn on one's finger or toe. It is further desirable to provide a single digit mounting structure for a puppet which permits adjustability and interchangeability of various characters or figurines.

SUMMARY OF THE INVENTION

The present invention advantageously provides a novelty or amusement device in the form of a toe or finger-mounted puppet which provides a relatively high degree of comic animation in response to a nominal amount of toe or finger flexure. The puppet depends upon a unique, yet simple mounting structure which mimics the advance and retreat of a chosen character or figurine.

In one aspect of the invention, a puppet is adapted to be mounted on a single human digit for providing animated motion of a figurine responsive to movement of the single human digit. The puppet comprises a hollow, elastic cap having an interior wall defining a cavity into which the single human digit is snugly received. The cap includes a resilient neck portion for supporting the figurine at a distance spaced from the single human digit such that movement of the single human digit causes the neck portion and the figurine to oscillate to and fro. In the preferred embodiment, the neck portion is constructed and arranged to be one-piece with the elastic cap. In an alternative embodiment, the neck portion is a separate element constructed and arranged to be attached to the elastic cap.

In another aspect of the invention, a puppet is adapted to be mounted on a single digit of a human appendage for providing animated motion of a figurine responsive to flexure of the single digit. The puppet comprises a hollow, elastic cap having an interior wall defining a cavity into which the single digit is snugly received. The cap includes a resilient, solid, elongated neck portion extending upwardly and rearwardly with respect to the single digit for supporting the entirety of the figurine at a distance spaced from the single digit such that flexure of the single digit causes the figurine to travel in a predominantly forward and backward path relative to the human appendage.

In yet another aspect of the invention, a toe puppet is adapted to be mounted on the large toe for providing animated motion of a character responsive to wiggling movement of the large toe. The puppet comprises a hollow, elastic cap having an interior wall defining a cavity into which the large toe is snugly received. The cap includes a resilient, solid, elongated neck portion extending upwardly and rearwardly with respect to one's foot for supporting the character at a distance spaced from the large toe such that, due to the length of the neck portion and the weight of the character, wiggling movement of the large toe causes the character to traverse back and forth. The character is friction fit on the neck portion to allow adjustability and interchangeability of the character on the neck portion.

BRIEF DESCRIPTION OF THE DRAWINGS

The invention will become better understood by reference to the following detailed description of the preferred exemplary embodiment when read in conjunction with the appended drawing wherein like numerals denote like elements.

DETAILED DESCRIPTION OF THE PREFERRED EMBODIMENT

Figure 1:
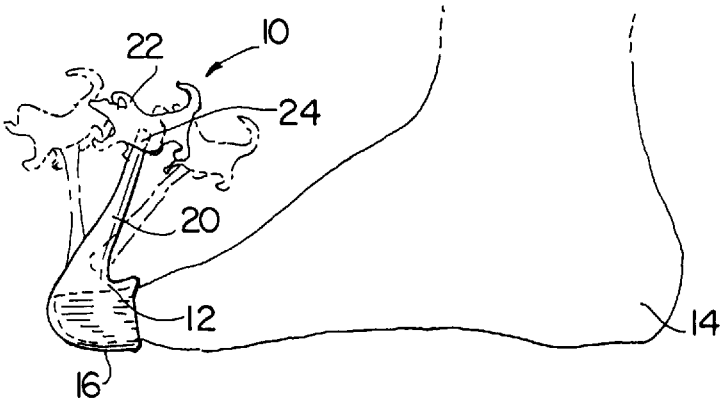
FIG. 1 is a perspective view of a human foot showing a mounting digit in the form of a large toe provided with the puppet embodying the present invention.

Referring now to FIG. 1, there is shown a puppet generally identified by the reference numeral 10 as mounted on a single digit of a human appendage, in this case, the large toe 12 of a person's foot 14.

Figure 2:
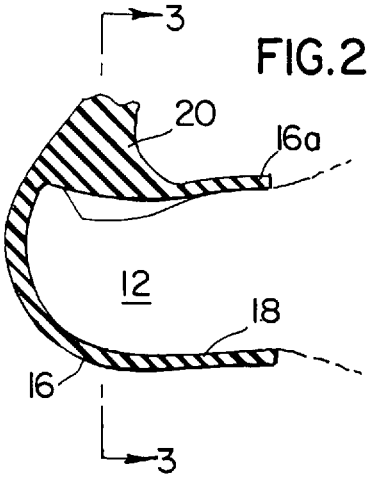
FIG. 2 is an enlarged, fragmentary sectional view illustrating the elastic cap integrally formed with the neck portion embodying the present invention.
Figure 4:
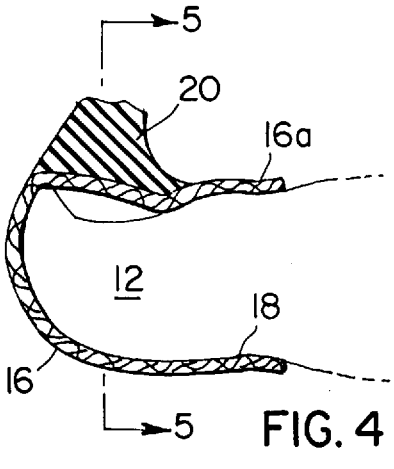
FIG. 4 is an enlarged, fragmentary sectional view illustrating an alternative embodiment of the invention illustrating the elastic cap bonded or otherwise affixed to the neck portion.

The puppet 10 comprises a hollow, elastic cap 16 preferably formed of soft rubber or the like. The cap 16 has an interior wall 18 defining a cavity into which the large toe 12 is snugly received. The cap 16 includes a resilient, solid, elongated neck portion 20 constructed preferably of rubber, which extends from an upper portion 16*a* of the cap 16 upwardly and rearwardly with respect to the large toe 12. The neck portion 20 functions as a mounting structure to support a figurine or character 22 at a predetermined distance spaced from the large toe 12. In the preferred embodiment shown in FIGS. 2 and 3, the cap 16 is molded or otherwise formed in one piece with the neck portion 20. In an alternative embodiment shown in FIGS. 4 and 5, the neck portion 20 is a separate element which is bonded or similarly attached to the elastic cap 16 which is formed of an elastic fabric material such as spandex or the like. In each embodiment, the neck portion 20 has a free end 24 which is typically friction fit into the figurine or character 22 in such a manner that an interchangeable figurine or character 22 may be readily attached and detached from the neck portion 20.

Due to the length and resiliency of the neck portion and the weight of the figurine or character 22, minimal flexure or wiggling movement of the large toe 12 fitted with the puppet 10 will cause the figurine or character 22 to traverse to and fro or oscillate in a predominantly backward and forward path which mimics the advance and retreat of the figurine or character 22 and provides an amusing effect. However, depending on the dexterity and control of one's single digit, one may also move or oscillate the figurine or character 22 to and fro in a limited lateral or circular motion.

Figure 3:
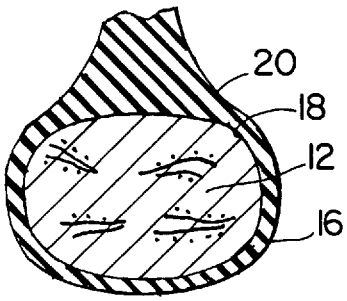
FIG. 3 is a sectional view taken on line 3—3 of FIG. 2.
Figure 5:
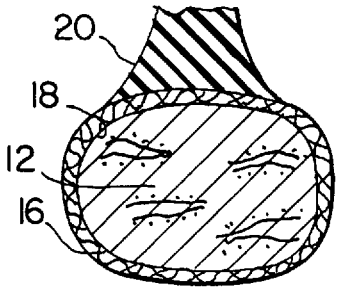
FIG. 5 is a sectional view taken on line 5—5 of FIG. 4.

Neck portion 20 is constructed such that it provides a relatively gradual and constant taper in its depth between upper wall 16*a* and free end 24. Neck portion 20 has a relatively great reduction in its width at its base adjacent upper wall 16*a*, as shown in FIGS. 3 and 5, and thereabove tapers gradually and constantly toward free end 24. This provides a reduction in the overall cross-section of neck portion 20 toward free end 24. During movement of the user's toe 12, figurine 22 experiences compound back and forth movement under the influence of its own weight movement caused by flexure of neck portion 20 due to its tapered cross-section, and movement of neck portion 20 as a whole relative to cap 16.

It should be appreciated that by virtue of the friction fit mounting of the figurine or character 22 on the neck portion 20, the figurine or character 22 may be adjustably positioned upwardly or downwardly as well as from side-to-side depending on the male and female design of the figurine or character 22 and the free end 24 of the neck portion 20. It should also be understood that other figurines or characters 22 may be mounted on other single digits of the hand or foot to provide the desired effect.

While the invention has been described with reference to a preferred embodiment, those skilled in the art will appreciate that certain substitutions, alterations and omissions may be made without departing from the spirit thereof. For example, while the puppet 10 of the present invention is shown mounted on the large toe of a human foot, the elastic cap of the puppet is also conformable to the shape of a finger on one's hand. Accordingly, the foregoing description is meant to be exemplary only, and should not be deemed limitative on the scope of the invention set forth with following claims.

I claim:

1. A puppet adapted to be mounted on a human digit for providing animated motion of a figurine responsive to movement of the human digit, the puppet comprising:

a hollow, elastic cap having an interior wall defining an axially-extending cavity for snugly receiving said human digit; and a resilient neck having a proximal end connected to said cap and a distal end secured to said figurine, said neck extending along an axis transverse to the cavity axis wherein the neck is tapered so as to decrease in transverse dimension in a direction from said proximal end toward said distal end, and wherein said figurine is mounted to the distal end of said neck and is spaced from said cap, said neck and said figurine being oscillatable to and fro in response to movement of said human digit.

2. The puppet of claim 1, wherein said figurine is removable from said neck and interchangeable with another figurine.

3. The puppet of claim 1, wherein said neck is constructed and arranged to be one-piece with said elastic cap.

4. The puppet of claim 1, wherein said neck is a separate element constructed and arranged to be attached to said elastic cap.

5. The puppet of claim 1, wherein said neck is a solid member extending from an upper portion of said elastic cap.

6. A puppet adapted to be mounted on a digit of a human appendage for providing animated motion of a figurine responsive to flexure of the digit, the puppet comprising:

a hollow, elastic cap having an interior wall defining an axially-extending cavity for snugly receiving said digit of said human appendage; and a resilient, solid, elongated neck extending upwardly with respect to said cap along an axis transverse to the cavity axis, wherein the figurine is mounted to the neck and the entirety of said figurine is supported at a distance relative to the cap, said figurine being movable in a predominantly forward and backward path relative to the human appendage in response to flexure of said digit.

7.The puppet of claim 8, wherein said figurine is adjustable, and attachable and detachable from said neck by means of a friction fit.

8. The puppet of claim 6, wherein said elastic cap is constructed of a material enabling the cap to be conformable to the shape of the digit.

9. A toe puppet adapted to be mounted on a person's toe for providing animated motion of a character responsive to wiggling movement of the toe, the puppet comprising:

a hollow, elastic cap having wall and an end wall defining an open-ended axially-extending cavity for snugly receiving said toe, said cap including a resilient, elongated tapered neck portion extending upwardly with respect to the side wall along an axis transverse to the axis of the cavity and supporting said character at a distance spaced upwardly from said cap, said character being movable back and forth in response to movement of said cap due to the taper and length of said neck portion and the weight of said character, and said character being friction fit on said neck portion to allow adjustability and interchangeability of said character on said neck portion.

10. A puppet, comprising:

a cap having a side wall and an end wall defining a passage for receiving a digit of a human appendage, wherein the cap defines spaced first and second ends and wherein the passage extends inwardly from the first end along a first longitudinal axis;

a resilient neck connected to the cap and extending therefrom along a second longitudinal axis transverse to the first longitudinal axis, wherein the neck is connected to the cap at a location spaced from the first end of the cap such that a portion of the side wall is disposed between the neck and the first end of the cap; and a figure secured to the neck, wherein movement of the cap is transferred through the neck to the figure so as to move the figure in response to movement of the digit.

11. The puppet of claim 10, wherein the neck defines a proximal end adjacent the cap and a distal end adjacent the figure, and wherein the neck tapers in transverse dimension from the proximal end toward the distal end.

* * * * *

UNITED STATES PATENT AND TRADEMARK OFFICE

CERTIFICATE OF CORRECTION

PATENT NO. : 5,830,035

DATED : November 3, 1998

INVENTOR(S) : DAVID J. BUDRECK

It is certified that error appears in the above-identified patent and that said Letters Patent is hereby corrected as shown below:

Claim 7, column 4, line 21, delete "8" and substitute therefor -- 6 --; Claim 9, column 4, line 31, after "having" insert -- a side --.

Signed and Sealed this

Twelfth Day of September, 2000

*Attest:*

Q. TODD DICKINSON

*Attesting Officer*

*Director of Patents and Trademarks*